United States Patent [19]

Chiang et al.

[11] Patent Number: 4,613,429

[45] Date of Patent: Sep. 23, 1986

[54] PROCESS FOR REMOVING MINERAL MATTER FROM COAL

[75] Inventors: Shiao-Hung Chiang; George E. Klinzing, both of Pittsburgh, Pa.

[73] Assignee: University of Pittsburgh, Pittsburgh, Pa.

[21] Appl. No.: 628,291

[22] Filed: Jul. 5, 1984

[51] Int. Cl.[4] ..... B03D 1/00

[52] U.S. Cl. ..... 209/5; 209/162; 44/15 R

[58] Field of Search ..... 209/5, 162, 163, 171, 209/49; 239/591; 44/1 R, 15 R; 406/109, 56

[56] References Cited

U.S. PATENT DOCUMENTS

| | | | |
|---|---|---|---|
| 2,142,207 | 1/1939 | Price | 209/165 |
| 3,045,818 | 7/1962 | Müschenborn et al. | 209/49 |
| 3,998,604 | 12/1976 | Hinkley | 44/1 R |
| 4,173,530 | 11/1979 | Smith et al. | 209/9 |
| 4,198,291 | 4/1980 | Yoo et al. | 44/15 R |
| 4,206,610 | 6/1980 | Santhanam | 62/55 |
| 4,226,475 | 10/1980 | Frosch et al. | 239/591 |
| 4,248,698 | 2/1981 | Keller | 209/5 |
| 4,249,699 | 2/1981 | Smith et al. | 241/20 |
| 4,252,639 | 2/1981 | Smith et al. | 209/5 |
| 4,272,251 | 6/1981 | Beckberger | 44/15 R |
| 4,274,948 | 6/1981 | Robinson | 209/9 |
| 4,338,188 | 7/1982 | Guerre | 209/2 |
| 4,339,042 | 7/1982 | Windle et al. | 209/162 |
| 4,377,356 | 3/1983 | Santhanam | 406/109 |
| 4,456,526 | 6/1984 | Akimoto et al. | 209/49 |
| 4,488,838 | 12/1984 | Herud | 406/56 |
| 4,522,628 | 6/1985 | Savins | 44/15 R |

*Primary Examiner*—S. Leon Bashore
*Assistant Examiner*—William Bond
*Attorney, Agent, or Firm*—Arnold B. Silverman

[57] ABSTRACT

A process for removing mineral matter from feed coal employing liquid carbon dioxide. A water slurry of pulverized feed coal is mixed with liquid carbon dioxide. Demineralized coal is collected in the liquid carbon dioxide phase while separated mineral matter concentrates in the water phase. The two liquid phases are separately drawn off and their solid contents recovered.

12 Claims, 2 Drawing Figures

PROCESS FOR REMOVING MINERAL MATTER FROM COAL

BACKGROUND OF THE INVENTION

1. Field of the Invention

This invention relates to the separation of mineral matter (ash) from coal. It specifically relates to the use of liquid carbon dioxide for removing mineral matter from coal.

2. Description of the Prior Art

U.S. Pat. No. 2,142,207 discloses a froth flotation process for cleaning coal. Gaseous carbon dioxide is bubbled upwardly through an aqueous slurry of coal to form a froth floating on top of the slurry. The froth is then removed. There is no specific mention of deashing coal by the method. This method requires a pressure release to allow escape of the carbon dioxide gas and thereby accomplish frothing. It is apparent that pressure release is incompatable with the use of liquid carbon dioxide.

U.S. Pat. No. 3,998,604 discloses the use of carbon dioxide gas as a coal flotation agent. However, this patent fails to disclose the use of liquid carbon dioxide.

U.S. Pat. No. 4,198,291 discloses the separation of coal from minerals using liquid sulfur dioxide. However, liquid sulfur dioxide is not equivalent to liquid carbon dioxide because sulfur dioxide is an extremely noxious gas, while carbon dioxide is entirely harmless. In addition, unlike sulfur dioxide, carbon dioxide is readily available in very large quantities through onsite combustion of coal.

U.S. Pat. No. 4,206,610 discloses a method for transporting coal by slurrying finely divided coal in liquid carbon dioxide. However, this patent does not disclose the use of a liquid carbon dioxide phase in cooperation with a water phase for the separation of mineral matter from coal.

In spite of the prior art teachings, there remains a need for a non-toxic, low cost material which will accomplish the separation of minerals from coal in a simple manner.

SUMMARY OF THE INVENTION

This invention relates to a process for removing mineral matter from a water slurry of pulverized feed coal comprising contacting the coal-water slurry with liquid carbon dioxide in a contacting zone for a time sufficient for demineralized coal to collect in the liquid carbon dioxide phase and for concentrated coal minerals to collect in the water phase, removing the demineralized coal from the contacting zone and separately removing the concentrated coal minerals from the contacting zone.

The invention further relates to the recovery and recycle of the liquid carbon dioxide while maintaining it in the liquid state.

This invention also relates to transporting the demineralized coal comprising pumping a slurry containing it in liquid carbon dioxide.

This invention additionally relates to a method for dewatering the clean coal, permitting the production of dry coal. This feature is of particular significance for ultrafine coal and for low rank coal for which adequate dewatering is generally difficult to achieve.

It is, therefore, an object of this invention to provide a non-toxic, low cost, reusable material for the separation of minerals from coal.

It is another object of this invention to separate minerals from coal without resorting to cumbersome frothing or flotation methods.

It is a further object of this invention to provide a material for the separation of minerals from coal which is capable of carrying the treated coal from the system in convenient slurry form.

It is still another object of this invention to provide a material for the separation of minerals from coal in which the demineralized coal can form a slurry having a low viscosity so that it can be pumped long distances on an economic basis.

It is still another object of this invention to provide a convenient and effective dewatering method in the production of dry fine clean coal.

It is a further object of this invention to provide an effective method for minimizing the pyrophoric tendency of fine coal product by blanketing the fine coal in carbon dioxide, which is a known fire extinguishing medium.

These and other objects of the invention will be fully understood from the following description of the invention in reference to the figures attached hereto.

DESCRIPTION OF THE PREFERRED EMBODIMENTS

Figure 1:
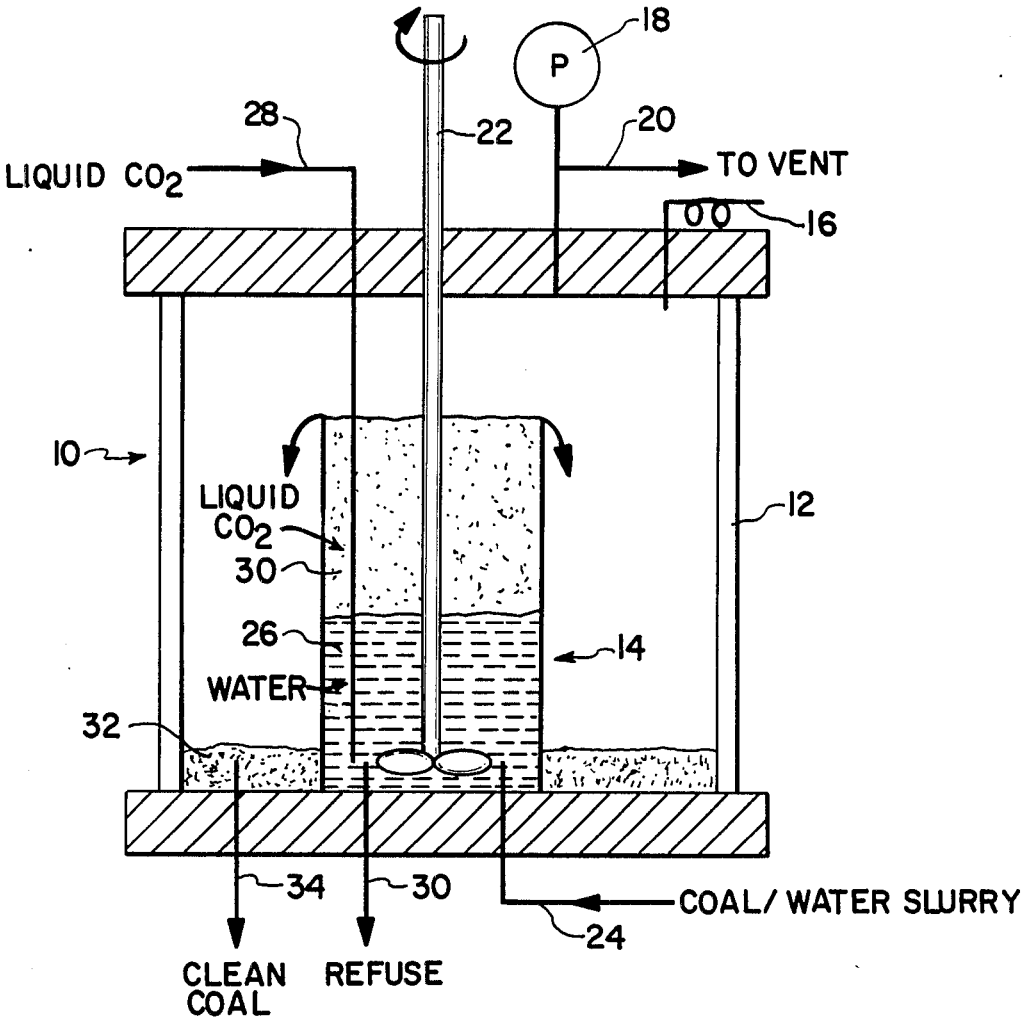
FIG. 1 illustrates schematically a batch system for performing the method of this invention.

The present method employs liquid carbon dioxide to remove mineral matter from feed coal.

The process is benefited by the smallness of the feed coal particles. Therefore, the coal is preferably first pulverized to a fine or ultrafine particle size such as, for example, smaller than 28 mesh, or even smaller than 200 mesh.

The pulverized coal is introduced in slurry with water to a pressurized separation chamber containing liquid carbon dioxide. The liquid carbon dioxide and liquid water form separate and distinct phases, with the liquid carbon dioxide forming an upper phase and the water forming a lower phase. The concentrated mineral content tends to remain as a slurry in the liquid water phase, while the coal tends to accumulate as a slurry in the liquid carbon dioxide phase.

The solids in the water phase have an elevated mineral content as compared to the feed coal while the solids in the carbon dioxide phase have a diminished mineral content as compared to the feed coal. The coal dispersed in the liquid carbon dioxide constitutes a slurry having a lower viscosity than a water slurry with the same coal and said relatively low viscosity slurry can be transported conveniently and economically by pumping.

The demineralized coal can be conveniently recovered from the slurry by settling. As a result, pressure release from the liquid carbon dioxide is not necessary. The demineralized coal will be recovered in a dry condition.

In a typical test of this invention, a coal containing 30 weight percent ash is reduced to about 8 to 9 weight percent ash in one treating cycle and to about 1.5 weight percent ash in two treating cycles.

In general, improved clean coal yields are achieved by reducing the particle size of the feed coal. The present method can be applied to various types and grades of coal such as, for example, bituminous coal, subbituminous coal, waste pond coal fines, ignite, peat moss, etc. The coal can be introduced in slurry with a liquid other than water so long as the liquid, like water, is immiscible with liquid carbon dioxide. Therefore, the term "process water" as used herein refers to such other immiscible liquids.

The present invention is believed to employ a surface phenomenon effect which occurs between coal and liquid carbon dioxide. We have discovered that when ultrafine coal in aqueous slurry is exposed to liquid carbon dioxide, the "clean" coal is completely wettable by liquid carbon dioxide, while loosely associated mineral matter is preferentially wetted by water. Therefore, when a water slurry containing fine coal and mineral particles is mixed with liquid carbon dioxide, "clean" coal particles tend to form aggregates and migrate to the liquid carbon dioxide phase, while mineral (ash) particles remain dispersed in the aqueous phase. It is apparently based on such selective transport of particles across the water/liquid carbon dioxide interface that the removal of mineral matter from "clean" coal can be achieved.

This invention does not rely upon any particular theory. However, it is not believed that there is a simple migration of coal particles from the aqueous phase to the liquid carbon dioxide phase where agglomeration occurs. Instead, it is believed that microscopic bubbles of carbon dioxide form and attach to nucleation sites on the coal particle surface due to small fluctuations of temperature or of carbon dioxide partial pressure in the system. Attachment of these bubbles to the coal surface can cause a significant reduction in apparent density of coal particles, leading to rapid movement of these particles from the heavier aqueous phase to the lighter liquid carbon dioxide phase. The process comprises establishing a contacting zone at a temperature and pressure such that carbon dioxide and a coal-process water slurry exist as a two phase liquid-liquid mixture. The coal-process water slurry is contacted with liquid carbon dioxide in the contacting zone. This allows the liquid carbon dioxide to preferentially coat the pulverized feed coal. The temperature and pressure in the contacting zone are such that carbon dioxide microbubbles form on the pulverized feed coal during the contacting step. A demineralized coal and a liquid carbon dioxide phase are separated as a relatively light fraction. A concentrated coal minerals and a process water phase are separated as a relatively heavy fraction. The relatively light fraction is removed from the contacting zone and the relatively heavy fraction is separately removed from the contacting zone.

Following are some important advantages of the liquid carbon dioxide process for cleaning pulverized coal:

1. The cost of carbon dioxide is low as compared to other non-aqueous media.

2. Carbon dioxide is readily available in large quantitites and can be generated on-site by burning the coal itself.

3. The viscosity of liquid carbon dioxide is low compared to water. Therefore, there are operating cost savings by handling liquid carbon dioxide coal slurries as compared to aqueous coal slurries.

4. Liquid carbon dioxide can be separated almost completely from the clean coal product fraction. No dewatering step is required.

5. The fugitive carbon dioxide poses no environmental problem.

6. The carbon dioxide is allowed to remain on the separated or demineralized coal. The residual carbon dioxide adsorbed on clean coal particles serves as an inert blanket minimizing any pyrophoric tendency of ultrafine coal in storage or during transit.

7. The present process can constitute an integral part of a coal liquid carbon dioxide slurry pipeline system for transporting coal.

Tests were performed on the two different coals shown in Table 1.

TABLE 1

| | Coal Sample Data | | | |
|---|---|---|---|---|
| | Proximate Analysis, wt % | | | |
| Coal | Fixed Carbon | Voltatile | Moisture | Ash |
| Pittsburgh Seam Coal (Bruceton Mine) | 53.7 | 35.7 | 5.6 | 5.0 |
| Illinois #6 (River King Mine) | 45.27 | 40.35 | 6.78 | 7.6 |

A schematic flow diagram of the batch test system employed is shown in FIG. 1. Essentially the contacting step comprises mixing the process water phase and the liquid carbon dioxide phase. In the separation step, the relatively light fraction and the relatively heavy fraction are established by allowing the contacted mixture to settle. The system consisted of a high pressure enclosure 10 having a glass window 12 in which a glass cylinder 14 was installed as the test cell. The temperature in the system was measured by means of thermocouple 16 while the pressure was measured by gauge 18 having an associated vent line 20. The system was agitated by means of a stirrer 22.

A coal-water slurry was introduced to glass cylinder 14 through line 24 to form aqueous layer 26. Liquid carbon dioxide was introduced through line 28 to form liquid carbon dioxide layer 30 by bubbling through water layer 26. Clean dewatered coal is carried from water layer 26 into carbon dioxide layer 30 to form a slurry which overflowed cylinder 14 to form a clean coal deposit 32 which was removed through line 34. The minerals were concentrated in aqueous layer 26 and were removed from the system through line 30.

The following steps were performed in each batch test run as described above:

(a) A coal-water slurry was fed to the test cell.

(b) The slurry was allowed to settle. The height of settled coal layer in the water phase was measured.

(c) In order to maintain the required pressure in the system, a sufficient amount of liquid carbon dioxide was introduced into the high pressure vessel in the space outside the cylindrical glass test cell. Once the pressure attained a steady value, liquid carbon dioxide was introduced into the test cell by bubbling through the coal-water slurry to cause mixing between the phases. The time interval for liquid carbon dioxide mixing was recorded.

(d) After liquid carbon dioxide mixing was terminated, the mixture was allowed time sufficient to separate into two immiscible phases. The "clean coal" portion was carried to the lighter liquid carbon dioxide phase while the "refuse" portion remained in the heavier water phase. The phases were separated and the solids were permitted to settle from each phase. The heights of the "clean coal" and "refuse" layers in the liquid carbon dioxide and water phases, respectively, were recorded.

(e) Samples of the clean coal fraction and the refuse fraction were collected and analyzed for ash content.

The experimental conditions were:

| | |
|---|---|
| Temperature, °F. | 75 |
| Aqueous slurry concentration, wt % of solid | 15-30 |
| Particle size | −32 mesh |
| Pressure, psig | 900 |
| Residence time, sec. | Up to 600 |
| Ash content, wt % (in feed coal) | 5-38 |

Table 2 shows the yield as a function of mixing or contact time of liquid carbon dioxide and the aqueous phase. Table 3 shows the ash content of the clean coal product fraction and that of the feed coal.

The definition of the yield is:

$$\text{Yield} = \frac{\text{Clean Coal in Liquid } CO_2 \text{ Phase}}{\text{Raw Coal in Feed Slurry}}$$

TABLE 2

Typical Yield Data

| Sample Coal | Feed Slurry Concentration (wt %) | Contact Time (sec) | Yield (%) |
|---|---|---|---|
| Pittsburgh (−32 mesh) | 20 | 30 | 0.54 |
| | | 60 | 0.62 |
| | | 90 | 0.77 |
| | | 120 | 0.85 |
| | | 150 | 0.92 |
| | | 180 | 0.92 |

Table 3

Typical Ash Reduction Data

| Sample Coal | Ash, wt % | |
|---|---|---|
| | Feed Coal | Clean Coal Product |
| Pittsburgh (−32 mesh) | 5.0 | 2.3 |
| Illinois #6 (−28 mesh) | 7.6 | 1.6 |

Figure 2:
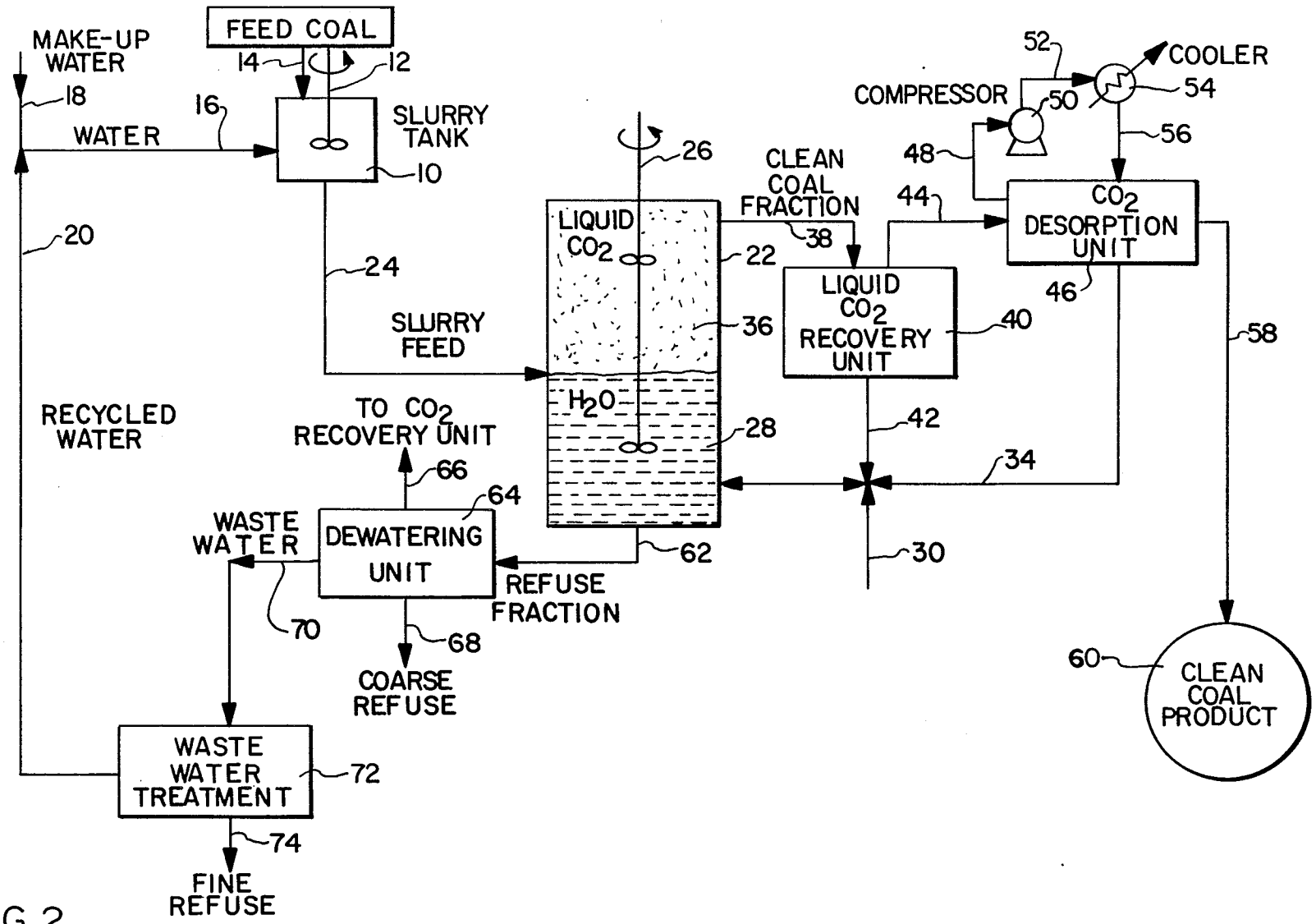
FIG. 2 illustrates schematically a continuous system for performing the method of this invention.

FIG. 2 illustrates a continuous process of this invention. Essentially, the contacting step comprises bubbling liquid carbon dioxide upwardly through the process water phase. The relatively light fraction and relatively heavy fraction are substantially continuously removed from the contacting zone. FIG. 2 shows slurry tank 10 having stirrer 12 to which feed coal is charged through line 14 and water is charged through line 16. The water includes make-up water from line 18 and recycled water from line 20.

The slurry from tank 10 is fed to separator chamber 22 through line 24 which is provided with stirrer 26 to form a water phase 28. Make-up liquid carbon dioxide entering through line 30 is mixed with recycle liquid carbon dioxide in lines 42 and 34 and charged to separator 22 at or near the bottom of water phase 28 and allowed to bubble upwardly and form liquid carbon dioxide phase 36.

The clean coal is allowed to concentrate in liquid carbon dioxide phase 36. Phase 36 is drawn off through line 38 to liquid carbon dioxide recovery unit 40. The bulk liquid carbon dioxide stream containing a small amount of coal is passed to recycle through line 42 while the clean coal stream containing a small amount of adsorbed carbon dioxide is passed through line 44 to carbon dioxide desorption unit 46.

If desired, the stream of clean demineralized coal in liquid carbon dioxide stream 38 can be pumped under pressure in a pipeline to a remote location instead of being passed to recovery unit 40.

Carbon dioxide which is desorbed from coal in desorption unit 46 is prepared for recycle by passage through line 48, compressor 50, line 52, cooler 54 and lines 56 and 34. Clean coal desorbed of most of its carbon dioxide content is passed through line 58 to clean coal collecter 60.

The mineral or refuse matter in the feed coal concentrates in water phase 28 which is removed from separator 22 through line 62 and passed to dewatering unit 64. Any carbon dioxide in unit 64 is discharged through line 66 for recovery while refuse is discharged through line 68. Water from unit 64 including the natural water of the feed coal passes through line 70 to waste water treatment vessel 72 from which fine refuse is recovered through line 74 and water is passed to recycle through line 20.

Any temperature and pressure conditions can be employed in the present process as long as the carbon dioxide is in the liquid state. For example, temperatures within the range of about 40° to 80° F. and pressures within the range of about 860 to 1000 psi are suitable. The particle size of the feed coal is generally below about 32 mesh, preferably below about 100 mesh, and most preferably below about 200 mesh (U.S. Sieve Series).

Whereas particular embodiments of the invention have been described above for purposes of illustration it will be evident to those skilled in the art that numerous variations of the details may be made without departing from the invention as defined in the following claims.

We claim:

1. A process for removing mineral matter from a process water slurry of pulverized feed coal comprising coal and coal minerals, the process comprising establishing a contacting zone at a temperature and pressure such that carbon dioxide and the coal-process water slurry exist as a two phase liquid-liquid mixture, contacting said coal-process water slurry with liquid carbon dioxide in said contacting zone so as to allow the liquid carbon dioxide to preferentially coat said pulverized feed coal, the temperature and pressure in the contacting zone further being such that carbon dioxide microbubbles form on said pulverized feed coal during said contacting step, separating a demineralized coal and a liquid carbon dioxide phase from said contacted mixture as a relatively light fraction and a concentrated coal minerals and process water phase as a relatively heavy fraction, removing said relatively light fraction from said contacting zone and separately removing said relatively heavy fraction from said contacting zone.

2. The process of claim 1 wherein said feed coal is bituminous coal.

3. The process of claim 1 wherein said feed coal is sub-bituminous coal.

4. The process of claim 1 wherein said feed coal comprises lignite.

5. The process of claim 1 including providing the demineralized coal which has collected in the liquid carbon dioxide phase and been removed from said contacting zone and separating said coal from the liquid carbon dioxide phase by settling.

6. The process of claim 5 including allowing the carbon dioxide to remain on the separated coal thereby reducing the pyrophoric tendency of the demineralized coal by providing a small amount of residual carbon dioxide which is adsorbed on the coal.

7. The process of claim 1 wherein said separated relatively light fraction is pumped under pressure in a pipeline.

8. The process of claim 1 including passing said relatively light fraction to a liquid carbon dioxide recovery unit, recovering liquid carbon dioxide from coal solids in said liquid carbon dioxide recovery unit, and recycling recovered liquid carbon dioxide to said contacting zone.

9. The process of claim 1 or 8 including passing said relatively heavy fraction to a water recovery unit, recovering water from mineral solids in said water recovery unit, and recycling recovered water to said contacting zone.

10. The process of claim 1 wherein the contacting step comprises bubbling liquid carbon dioxide upwardly through the process water phase wherein said relatively light fraction and said relatively heavy fraction are substantially continuously removed from said contacting zone.

11. The process of claim 1 wherein the contacting step comprises mixing the process water phase and the liquid carbon dioxide phase, and further comprises in the separation step, the relatively light fraction and the relatively heavy fraction are established by allowing the contacted mixture to settle.

12. A process for removing mineral matter from feed coal comprising establishing a contacting zone at a temperature and pressure such that carbon dioxide and the coal-process water slurry exist as a two phase liquid-liquid mixture, contacting said coal-process water slurry with liquid carbon dioxide in said contacting zone so as to allow the liquid carbon dioxide to preferentially coat said pulverized feed coal, the temperature and pressure in the contacting zone further being such that carbon dioxide microbubbles form on said pulverized feed coal during said contacting step, forming a liquid process water phase and a liquid carbon dioxide phase in said contacting zone, whereby said liquid process water phase contains solids which are richer in minerals than said feed coal, and said liquid carbon dioxide phase contains coal solids less rich in minerals than said feed coal, and separately removing said liquid process water phase and said liquid carbon dioxide phase from said contacting zone.

* * * * *